US007159371B1

(12) United States Patent
Thomas

(10) Patent No.: US 7,159,371 B1
(45) Date of Patent: Jan. 9, 2007

(54) KIT FOR FORMING AN ARCH OR ARCH SECTION

(76) Inventor: John S. Thomas, 612 W. Hargett St., Raleigh, NC (US) 27603

( * ) Notice: Subject to any disclaimer, the term of this patent is extended or adjusted under 35 U.S.C. 154(b) by 64 days.

(21) Appl. No.: 11/136,973

(22) Filed: May 25, 2005

Related U.S. Application Data

(62) Division of application No. 10/449,241, filed on May 30, 2003, now Pat. No. 6,898,903.

(51) Int. Cl.
*E04B 1/00* (2006.01)

(52) U.S. Cl. ..... 52/745.15

(58) Field of Classification Search ..... 52/86, 52/211, 212, 213, 745.07, 745.15, 2; D25/60
See application file for complete search history.

(56) References Cited

U.S. PATENT DOCUMENTS 568,351 A * 9/1896 Thomas ..... 56/38
4,301,632 A * 11/1981 Wagner ..... 52/211
4,400,917 A * 8/1983 Massaro et al. ..... 52/86
4,601,138 A * 7/1986 Hampton ..... 52/86
4,665,666 A * 5/1987 Hampton ..... 52/86
5,291,717 A * 3/1994 Turner ..... 52/745.07
5,526,618 A * 6/1996 Thomas ..... 52/211
5,572,834 A * 11/1996 Lilly ..... 52/85
5,588,265 A * 12/1996 Gill ..... 52/167.1
5,688,351 A 11/1997 Thomas
6,401,405 B1 * 6/2002 Hicks ..... 52/88

* cited by examiner

*Primary Examiner*—Naoko Slack
*Assistant Examiner*—Jessica Laux
(74) *Attorney, Agent, or Firm*—Coats & Bennett, P.L.L.C.

(57) ABSTRACT

A kit includes a series of components, capable of being flat packed, that can be assembled to form an arch or a section of an arch for use in a building such as a residential structure. The kit includes a pair of curved sides with each curved side including an inner face, an outer face, an upper edge and a lower edge. Formed along the inner face of each side is a curved groove. A flexible or pliable jamb is provided in the kit. Secured in spaced apart relationship along one side of the jamb is a series of clips. When assembled, the arch or arch section includes the clips extending between these sides and including portions that project into the curved grooves. The clips effectively secures the jamb to the sides.

11 Claims, 4 Drawing Sheets

KIT FOR FORMING AN ARCH OR ARCH SECTION

CROSS REFERENCE TO RELATED APPLICATION

This application is a divisional of U.S. patent application Ser. No. 10/449,241 filed on May 30, 2003, which will mature into U.S. Pat. No. 6,898,903 on May 31, 2005.

FIELD OF THE INVENTION

The present invention relates to building structures, and more particularly to a kit for forming arches within a structure.

BACKGROUND OF THE INVENTION

For many years, architects, home designers, contractors and consumers have not incorporated arched openings in structures, particularly residential homes. The aversion to arched openings has nothing to do with appeal or the demand for such. For so long, the cost factor has precluded arches from being routinely used in residential construction, especially homes in the lower to moderate price range. The basic problem giving rise to cost considerations is that in the past such arch structures have, for the most part, been constructed on site by highly skilled trim carpenters. Custom making arched openings, even when done by skilled and experienced craftsmen, is time consuming, tedious, and in the end, very expensive.

In recent years, architects, home designers and building contractors have had available to them prefabricated arch structures. For example, see U.S. Pat. No. 5,526,618, the disclosure of which is expressly incorporated herein by reference. In this patent, there is shown a prefabricated arch where the major components, including an arched header and a pair of columns, are prefabricated for installation into an opening within the structure. Such prefabricated arches have met with substantial commercial success. They can be manufactured in various sizes and with various moldings and trim. While these prefabricated arches have generally been successful in the marketplace, they still are not used on a routine basis in residential structures. There may be a variety of reasons for this, including the cost of such prefabricated arch structures. In addition, many such prefabricated arch structures are still custom made off site and shipped to a distributor or contractor for use in a particular building. Such structures are difficult and expensive to ship, not to mention the problems that often arise because of damage sustained in shipment.

Therefore, there continues to be a need for an arch structure that can be used in a wide variety of applications and which can be sold at a price point that will make arch structures suitable for homes within a wide price range.

SUMMARY OF THE INVENTION

The present invention entails a kit for forming or assembling an arch where the components are packaged and delivered to a wholesale or retail outlet where consumers, builders and contractors purchase the kits and thereafter install them in existing homes as well as new homes and other structures.

The kit of the present invention includes a pair of curved sides with each side including a curved groove formed in the same. A jamb is provided and is adapted to assume a curve configuration. A series of clips is also provided with each clip secured to the jamb and extending therefrom. When the arch or arch section is assembled, the clips include portions that project into the curved groove formed in each side. Thus, the clips effectively secure the jamb to the curved sides.

The present invention also entails a method of forming an arch or an arch section for use in a building such as a residential structure. This method includes securing a flexible jamb to a pair of curved sides by projecting a series of spaced apart clips from the jamb into a pair of grooves formed on the sides. When assembled, the jamb is secured to an edge of the two sides such that the two sides and the jamb effectively form an arch or a section of an arch.

Other objects and advantages of the present invention will become apparent and obvious from a study of the following description and the accompanying drawings, which are merely illustrative of such invention.

DESCRIPTION OF EXEMPLARY EMBODIMENT OF THE INVENTION

With further reference to the drawings, the kit of the present invention is shown therein and indicated generally by the numeral 10. As will be appreciated from subsequent portions of this disclosure, kit 10 is designed to enable an individual to form or assemble an arch, or a section of an arch, for use in a building such as a residential structure.

Figure 1:
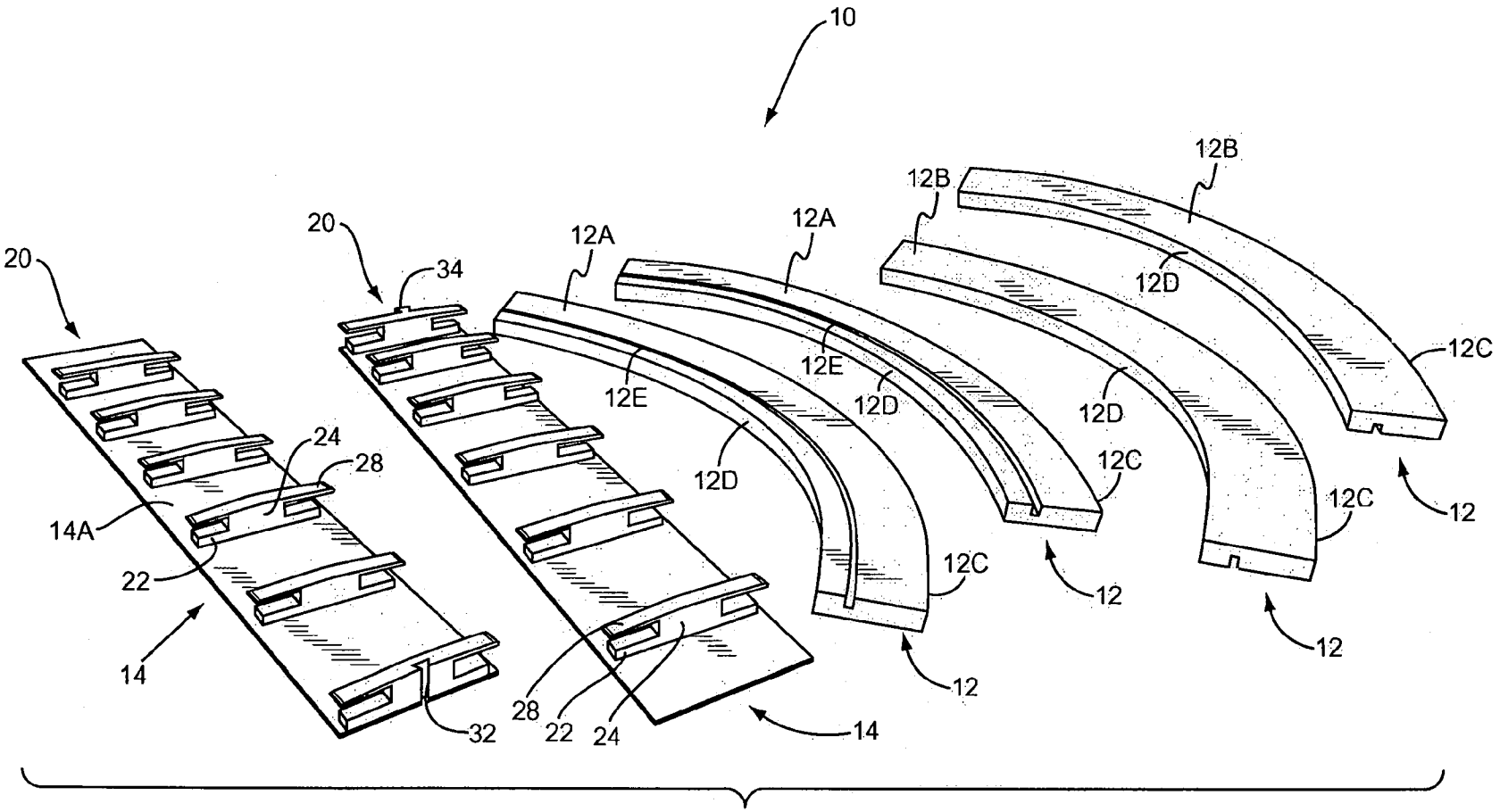
FIG. 1 illustrates the components of a typical kit for the arch section of the present invention.

With particular reference to FIG. 1, one embodiment of the kit is illustrated therein. At the outset, it should be noted that the kit illustrated in FIG. 1 is adapted to form two arch sections that are joined together. Some kits may simply include sufficient components to form one arch or one arch section. In any event, kit 10 of the present invention includes a series of sides with each side being curved and indicated generally by the numeral 12. Essentially, all of the sides 12 are very similar or identical. Thus, a discussion of one side will suffice for all of the sides shown in FIG. 1. In that regard, each side includes an inner side 12A and an outer side 12B. Further, each side includes an upper curved edge 12C and a lower curved edge 12D. Formed about the inner side 12A is a curved groove 12E. Sides 12 can be constructed of various materials such as wood or a medium density fiberboard, plastic or various other materials. In the case of the embodiment illustrated in FIG. 1, the outer side 12B is simply shown as being planar and unornamented. It will be appreciated by those skilled in the art, however, that the outer side 12B could be formed in the shape of a molding or otherwise ornamented so as to impart aesthetic appeal to the outer surface 12B of a respective side 12.

Figure 2:
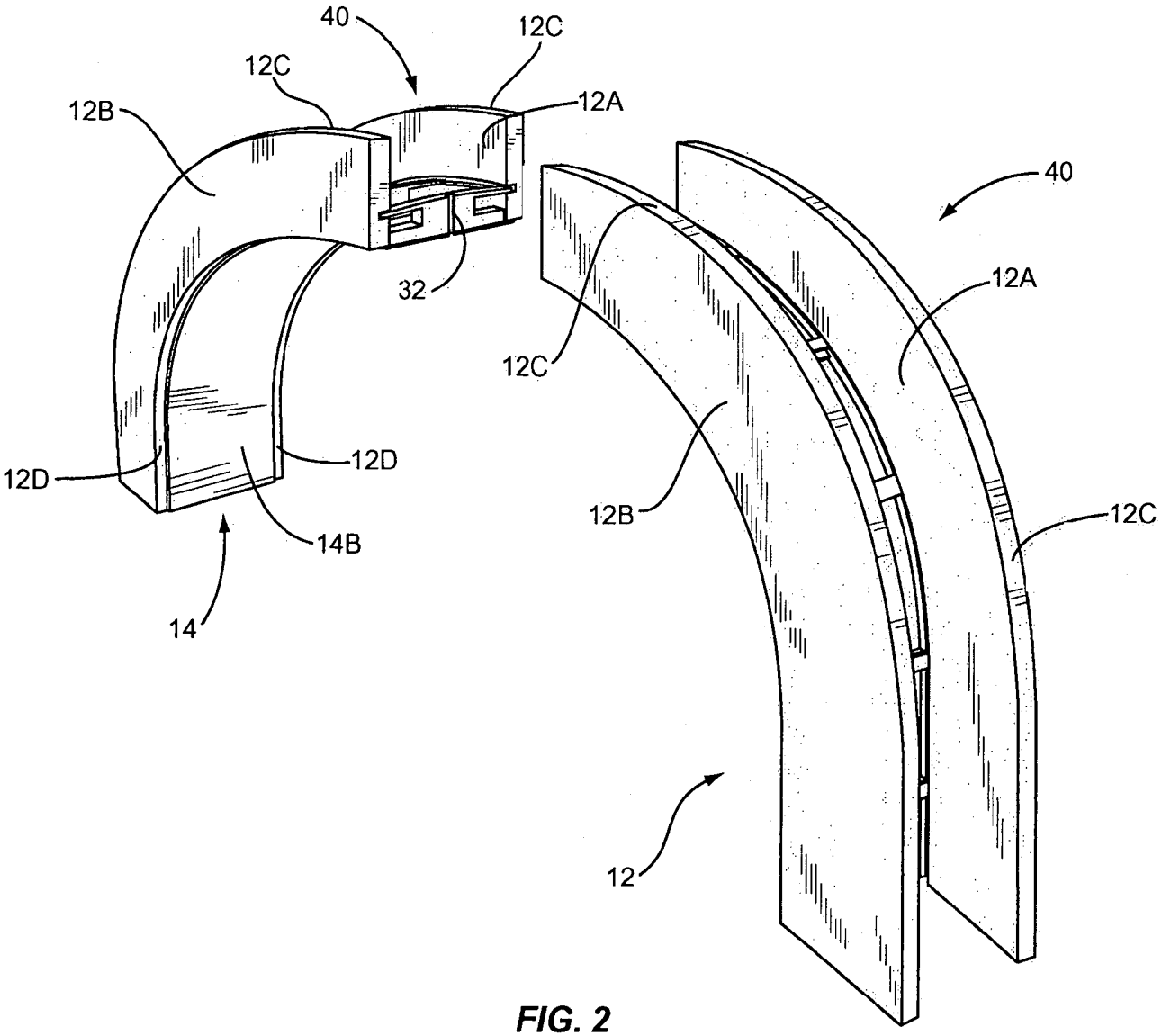
FIG. 2 is a perspective view of two arch sections, spaced from one another, assembled from the kit of the present invention.
Figure 3:
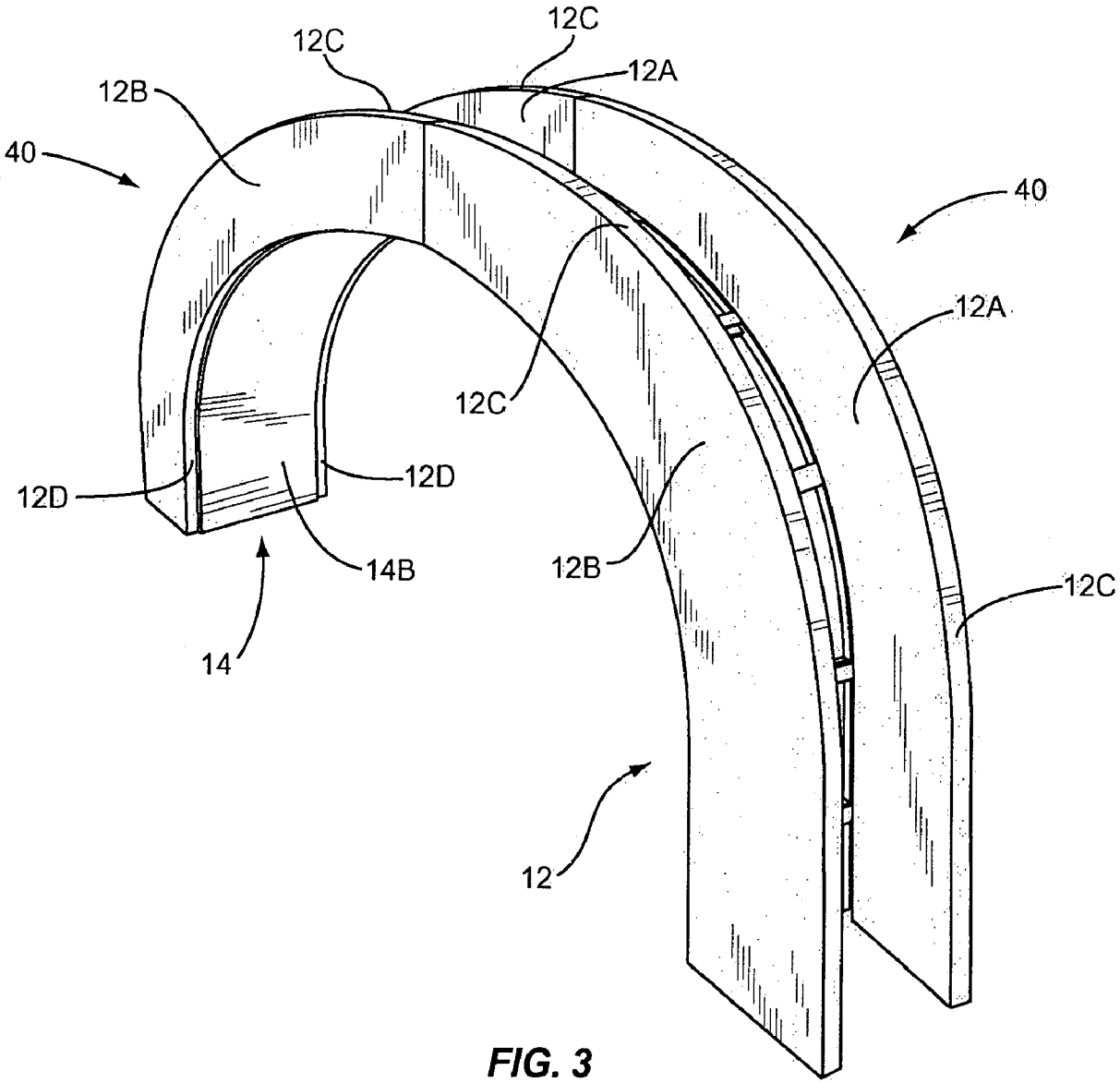
FIG. 3 is a perspective view showing the two arch sections of FIG. 2 joined together.

Kit 10 is further provided with a jamb or base indicated generally by the numeral 14. As will be appreciated from subsequent portions of this disclosure, the jamb 14 is designed to be connected between a pair of sides 12, as shown in FIGS. 2–4A. Jamb 14 includes a first side 14A and a second side 14B. The jamb can be made of various materials. Preferably jamb 14 is sufficiently flexible such that it can assume a generally straight configuration as shown in FIG. 1 and then curved to form a configuration such as shown in FIGS. 2 and 3. In one embodiment of the present invention, the jamb 14 could be made from ⅛" bendable plywood.

Secured to the first side 14A of jamb 14 is a series of spaced apart clips or fasteners indicated generally by the numeral 20. Clips 20 function to interconnect, fasten or secure the jamb 14 to a pair of sides 12. As detailed below, the clips include portions that project into the groove 12E of a pair of sides 12 and effectively pull a portion of the jamb 14 against the lower edges 12D of a pair of sides 12.

Figure 4:
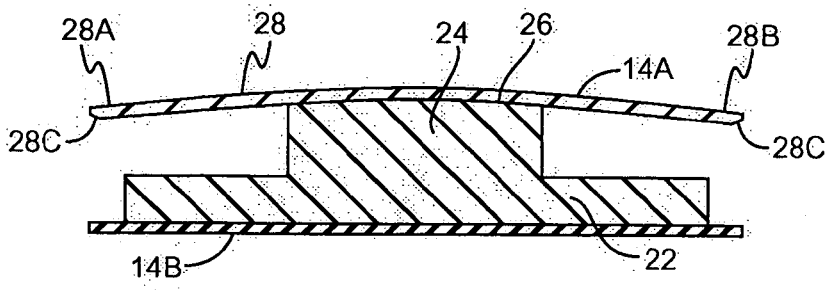
FIG. 4 is a cross-sectional view of the jamb and associated clip.

Viewing the clip 20 in more detail, it is seen from the drawings, particularly FIG. 4, that each clip includes a base that is secured to the first side 14A of the jamb. Note that the base extends transversely across the jamb 14. The base can be secured to the jamb by glue or other suitable means. The base includes a lower portion 22 that includes opposed ends that terminate just short of the adjacent edges of the jamb 14. Centrally disposed over the lower portion 22 and extending upwardly from the lower portion 22 is an upper portion 24. Note that the outer edges of the upper portion 24 terminate inwardly of the outer edges of the lower portion 22. The upper portion 24 includes a slightly curved or convex upper surface 26.

Secured to the base is a retainer 28. Retainer 28 is secured by glue or other suitable securing means to the curved upper surface 26 of the upper portion 24. Note that the span of the retainer extends beyond the outer ends of the lower portion 22. In particular, the retainer 28 includes end portions 28A and 28B. Each end portion 28A and 28B includes a beveled portion 28C. Bevel 28C facilitates the insertion or projection of the retainer 28 into the grooves 12E of the respective sides 12.

Figure 4A:
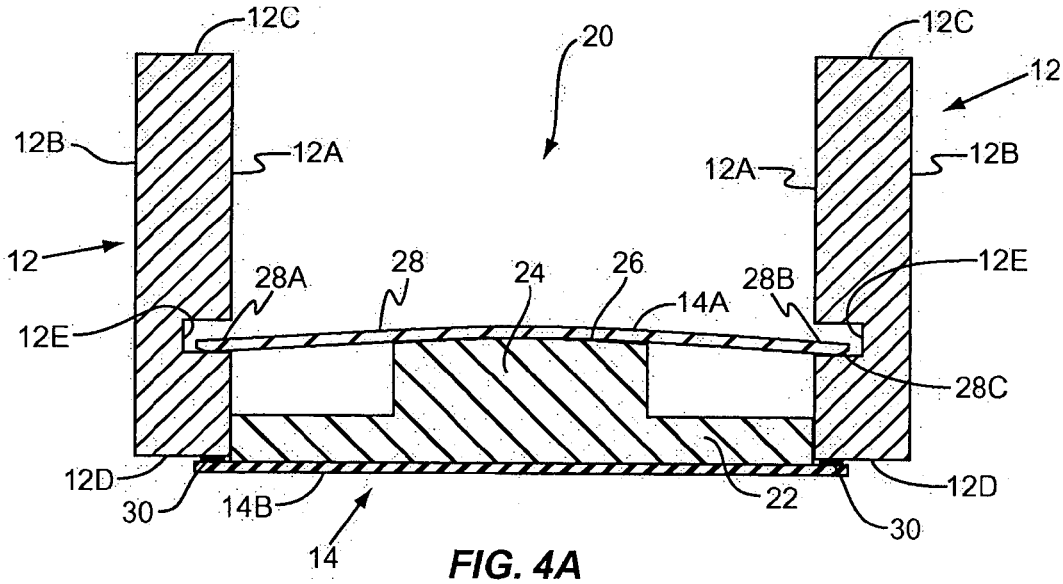
FIG. 4A is a cross-sectional view of an arch section.

With particular reference to FIG. 4A, there shown therein a cross-sectional view showing the jamb 14 secured to a pair of sides 12. Note that the retainer 28 in one embodiment, has some flexibility and acts, at least slightly, like a spring. When the opposite ends 28A and 28B of the retainer 28 are inserted into the grooves 12E, then the spring action of the retainer 28 tends to pull the jamb 14, or at least edges thereof, into engagement with the lower edge 12D of the sides 12. Note also that the opposed ends of the lower portion 22 of the base generally abut against or terminate just short of the inner side 12A of the sides 12 at a point or area just below the respective grooves 12E.

To secure the jamb to the sides 12, a line of glue is placed along each edge of the first side 14A. Thus when the jamb 14 is pulled into engagement with the lower edges 12D of the sides 12, a glue joint is formed between the jamb and the lower edges 12D of the sides 12. In FIG. 4, the glue joint is referred to by the numeral 30.

Therefore, it is appreciated that the clips 20 effectively secure the jamb 14 to two sides 12 and that together the sides 12, jamb 14 and clips 20 form an arch or an arch section.

Figure 5:
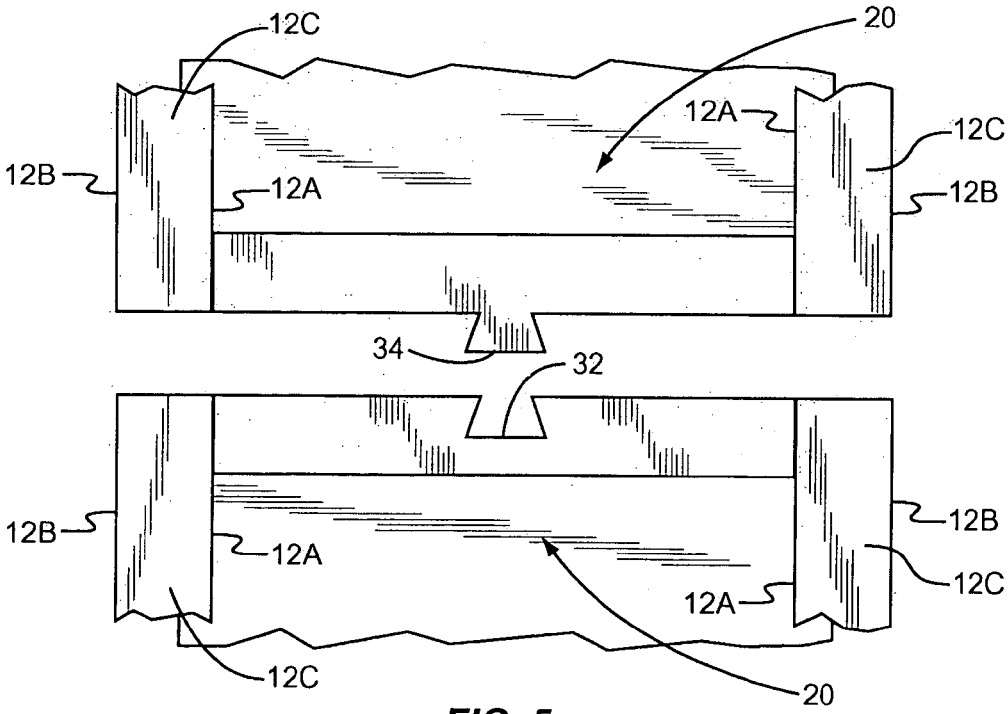
FIG. 5 is a fragmentary plan view of end portions of two arch sections.

In FIG. 2, two arch sections 40 are formed from the kit illustrated in FIG. 1. To secure the two arch sections 40 of FIG. 2 together, a dovetail joint can be provided. This dovetail joint is illustrated in FIGS. 2 and 5. Note that the two end portions of the two arch sections 40 shown in FIG. 2 are constructed such that the end of the jamb 14, the end of the sides 12 and the outer facing side of the clips 20 are all generally flush or even. In addition, one of the clips 20 would be provided with a female slot 32. Adjoining or connecting male insert 34 is provided with the other adjacent clip 20. Thus, one arch section 40 can be connected to another arch section 40 by sliding the male insert 34 into the female slot 32. To make a secure joint, glue can be provided and further the male insert 34 in the female slot 32 can be designed such that the joint created is self-locking as is common with dovetail joints.

As noted before, the kit of the present invention can be equipped with components to make one arch section or multi arch sections. Typically, these arch structures or sections are utilized in the manner described in U.S. Pat. No. 5,526,618. As can be seen in the drawings, the top portion of the arch structure arch section formed by the kit of the present invention is open. Therefore, the arch structure or arch section can be inserted upwardly around the top portion of a wall structure that is disposed adjacent an opening. The kit could be provided with a pair of capitals that would be utilized to make a transition from the lower ends of the formed arch to the jambs formed along the sides of the opening in which the arch is being fitted. Alternatively, the kit could be provided with a pair of unassembled columns of the type shown in U.S. Pat. No. 5,526,618.

The clips or fasteners 20 can assume different designs and configurations. Basically an arch or arch section will include at least one clip or fastener that extends from the jamb and connects in some way with the sides 12. In one embodiment, the arch or arch section kit is designed such that the jamb is secured into abutment with the lower edges 12D of the sides 12. In this embodiment, the clip or fastener extends from the jamb 14 between the sides 12. Again, the clip or fastener can connect or engage the sides in various ways in order to secure the jamb to the sides.

Also, it is noted that in the embodiment illustrated herein, that the jamb 14 is secured so as to leave a portion of the lower edge 12D exposed. This is particularly illustrated in FIGS. 2, 3 and 4A.

From the foregoing specification and discussion, it is seen that the arch kit of the present invention provides a series of components that can be readily assembled into an arch structure or a section of an arch structure. The components are designed so as to enable individuals that are not highly skilled craftsmen to readily assemble an arch structure and install it in a building without professional assistance. Further, the design of the present kit enables the arch to be packaged in a very compact and efficient manner, such as flat packing, that makes mass merchandising practical and also provides for the possibility of utilizing arch structures in low to medium range priced homes.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A method of forming an arch for use in a building such as a residential structure, comprising: securing a flexible jamb to a pair of curved sides by projecting a series of spaced apart clips from the jamb into a pair of grooves formed on the sides.

2. The method of claim 1 including pulling the jamb into engagement with a pair of edges of the sides as a result of the clips projecting into the grooves.

3. The method of claim 1 wherein the clips include retainers that extend between the sides and project into the grooves so as to effectively pull the jamb into contact with edges of the sides.

4. The method of claim 1 including placing glue on selected portions of the jamb and wherein the clips pull the areas of the jamb having the glue thereon into engagement with edges on the sides.

5. The method of claim 1 wherein the clips are secured to one side of the jamb in spaced apart relationship and wherein the method entails inserting the clips into the groove of one side of the arch and then inserting the clips into the other side of the arch.

6. A method of forming an arch for use in a building such as a residential structure comprising securing a flexible jamb to a pair of curved sides having upper and lower curved edges by extending at least one fastener from the jamb and connecting the fastener with the sides such that the jamb abuts against and extends around the lower edges of the sides.

7. The method of claim 6 including connecting the fastener to inner faces of the sides.

8. The method of claim 6 including extending the fastener into engagement with a curved groove formed on the inner face of each side.

9. The method of claim 6 including applying glue between the jam and the lower edges of the sides.

10. The method of claim 6 including projecting the fastener from one side of the jamb upwardly between the two curved sides.

11. The method of claim 6 wherein the jamb includes a pair of outer edges and wherein each side includes an outer face and wherein the method entails terminating the outer edges of the jamb short of the outer faces of the sides and thereby leaving a portion of the lower edges of the sides exposed.

* * * * *